US008412091B2

(12) United States Patent
Iguchi et al.

(10) Patent No.: US 8,412,091 B2
(45) Date of Patent: Apr. 2, 2013

(54) IMAGE ERASING APPARATUS AND METHOD OF CARRYING RECORDING MEDIUM IN IMAGE ERASING APPARATUS

(75) Inventors: Ken Iguchi, Shizuoka (JP); Isao Yahata, Shizuoka (JP); Takahiro Kawaguchi, Shizuoka (JP); Hiroyuki Taguchi, Shizuoak (JP); Hiroyuki Tsuchihashi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 316 days.

(21) Appl. No.: 12/816,938

(22) Filed: Jun. 16, 2010

(65) Prior Publication Data

US 2010/0323286 A1 Dec. 23, 2010

Related U.S. Application Data

(60) Provisional application No. 61/218,822, filed on Jun. 19, 2009, provisional application No. 61/218,828, filed on Jun. 19, 2009.

(51) Int. Cl.
*G03G 15/00* (2006.01)

(52) U.S. Cl. ..... 399/411

(58) Field of Classification Search ..... 399/405, 399/411, 341
See application file for complete search history.

(56) References Cited

U.S. PATENT DOCUMENTS

| | | | | |
|---|---|---|---|---|
| 2006/0067770 | A1* | 3/2006 | Terao et al. | 399/405 |
| 2007/0086795 | A1* | 4/2007 | Pee | 399/16 |
| 2007/0217845 | A1* | 9/2007 | Fuchimoto | 399/405 |
| 2009/0087240 | A1* | 4/2009 | Tamura et al. | 399/405 |
| 2009/0154970 | A1 | 6/2009 | Yoshida et al. | |

* cited by examiner

*Primary Examiner* — Quana M Grainger
(74) *Attorney, Agent, or Firm* — Patterson & Sheridan, LLP

(57) ABSTRACT

An image erasing apparatus includes a recording medium height sensor sensing the height of recording mediums stacked on a discharge tray, a discharge tray lifting and lowering mechanism lifting and lowering the discharge tray, a shifting mechanism shifting and discharging the recording mediums, and a controller controlling a discharging operation so that the height of recording mediums on the discharge tray is equal to a desired height on the basis of the output of the recording medium height sensor.

20 Claims, 5 Drawing Sheets

IMAGE ERASING APPARATUS AND METHOD OF CARRYING RECORDING MEDIUM IN IMAGE ERASING APPARATUS

CROSS-REFERENCE TO RELATED APPLICATIONS

This application is based upon and claims the benefit of priority from the prior the U.S. patent application Ser. No. 61/218,822, filed on Jun. 19, 2009, and the prior the U.S. patent application Ser. No. 61/218,828, filed on Jun. 19, 2009 and the entire contents of which are incorporated herein by reference.

FIELD

The present invention relates to an image erasing apparatus erasing an image of a recording medium on which the image is formed with erasable developer, and a method of carrying a recording medium in an image erasing apparatus.

BACKGROUND

In recent years, with the requirement of saving resources, an image forming apparatus forming an image with erasable developer and an image erasing apparatus were introduced. This image erasing apparatus erases an image by applying heat or light to a recording medium on which the erasable developer forms an image to erase the developer. Accordingly, the erased recording medium can be reused.

An image is formed again on the recording medium from which the image is erased by the image forming apparatus. When recording mediums are fed to the image forming apparatus, the recording mediums are set into a sheet feed cassette.

Here, it was difficult for a user to acquire an amount of recording mediums suitable for the sheet feed cassette of the image forming apparatus by hand.

In view of this situation, a technique of sorting the image-erased recording mediums by size using a sorter is suggested as a related art.

DETAILED DESCRIPTION

Figure 1:
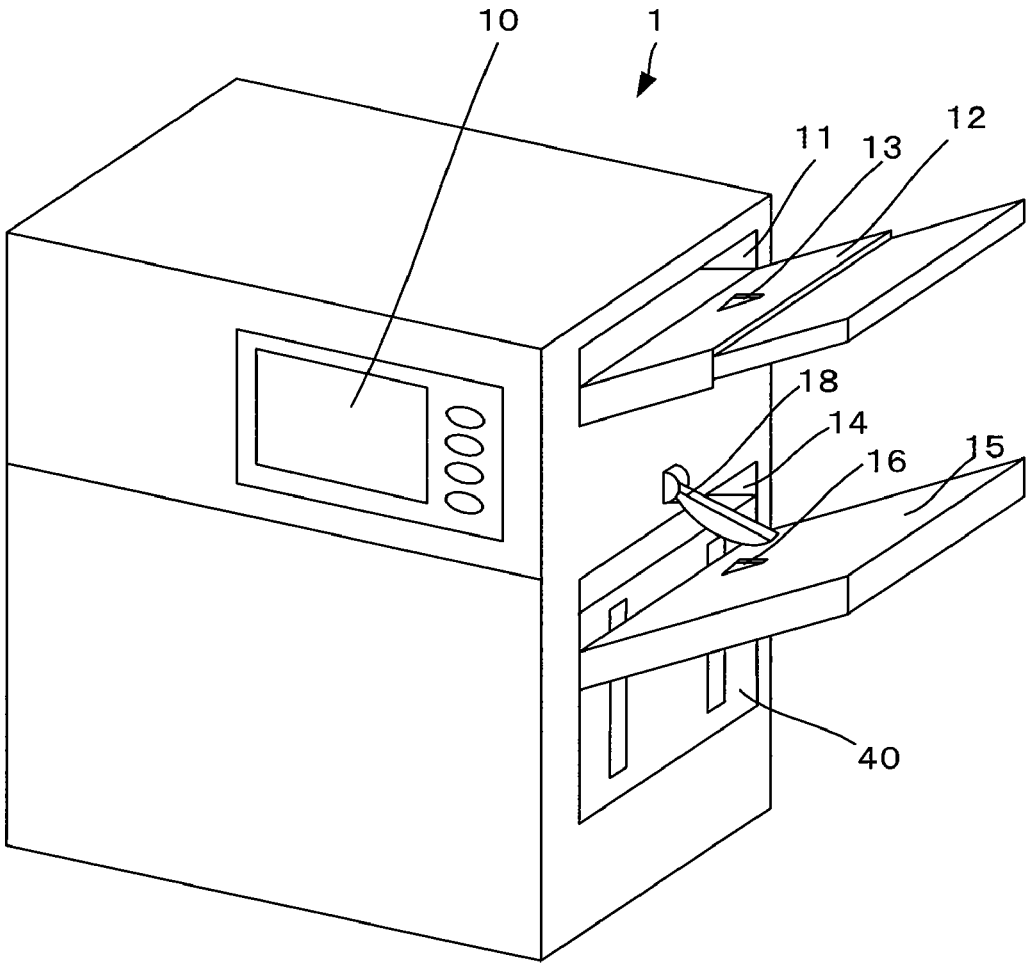
FIG. 1 is a perspective view illustrating a configuration of an image erasing apparatus according to an embodiment of the invention.

Throughout this description, the embodiments and examples shown should be considered as exemplars, rather than limitations on the apparatus and methods of the present invention.

Hereinafter, an image erasing apparatus and a method of carrying a recording medium in the image erasing apparatus according to an embodiment of the invention will be described in detail with reference to the accompanying drawings.

The image erasing apparatus 1 according to this embodiment includes a heater heating a recording medium to a temperature equal to or higher than a developer erasing temperature, an image reading device reading an image of the recording medium, a recording medium carrying mechanism 23 carrying the recording medium, a recording medium height sensor 18 sensing the height of the recording mediums stacked on a discharge tray 15, a discharge tray lifting and lowering mechanism 40 lifting and lowering the discharge tray 15, a shifting mechanism 26 shifting, that is, moving, and discharging the recording medium, and a controller controlling an operation of discharging a recording medium to form a sheet bundle with a desired height on the basis of the output of the recording medium height sensor 18.

FIG. 1 is a perspective view illustrating the configuration of the image erasing apparatus 1 according to this embodiment. As shown in FIG. 1, the image erasing apparatus 1 includes a recording medium reception port 11 receiving a recording medium from which an image should be erased, a stack tray 12 disposed in the recording medium reception port 11, and a recording medium sensor 13 disposed on the top surface of the stack tray to sense the existence of a recording medium.

The image erasing apparatus 1 includes a control panel 10 as an input and output device in a main body. The image erasing apparatus 1 includes a discharge port 14 for discharging an image-erased recording medium, the discharge tray 15 disposed in the discharge port 14 to stack the discharged recording medium thereon, a stacked medium sensor 16 disposed on the top surface of the discharge tray to sense the existence of a recording medium, and the discharge tray lifting and lowering mechanism 40 lifting and lowering the discharge tray 15.

The image erasing apparatus 1 includes a recording medium height sensor 18 disposed in the discharge port 14 to sense the height of the recording mediums stacked on the discharge tray.

Figure 2:
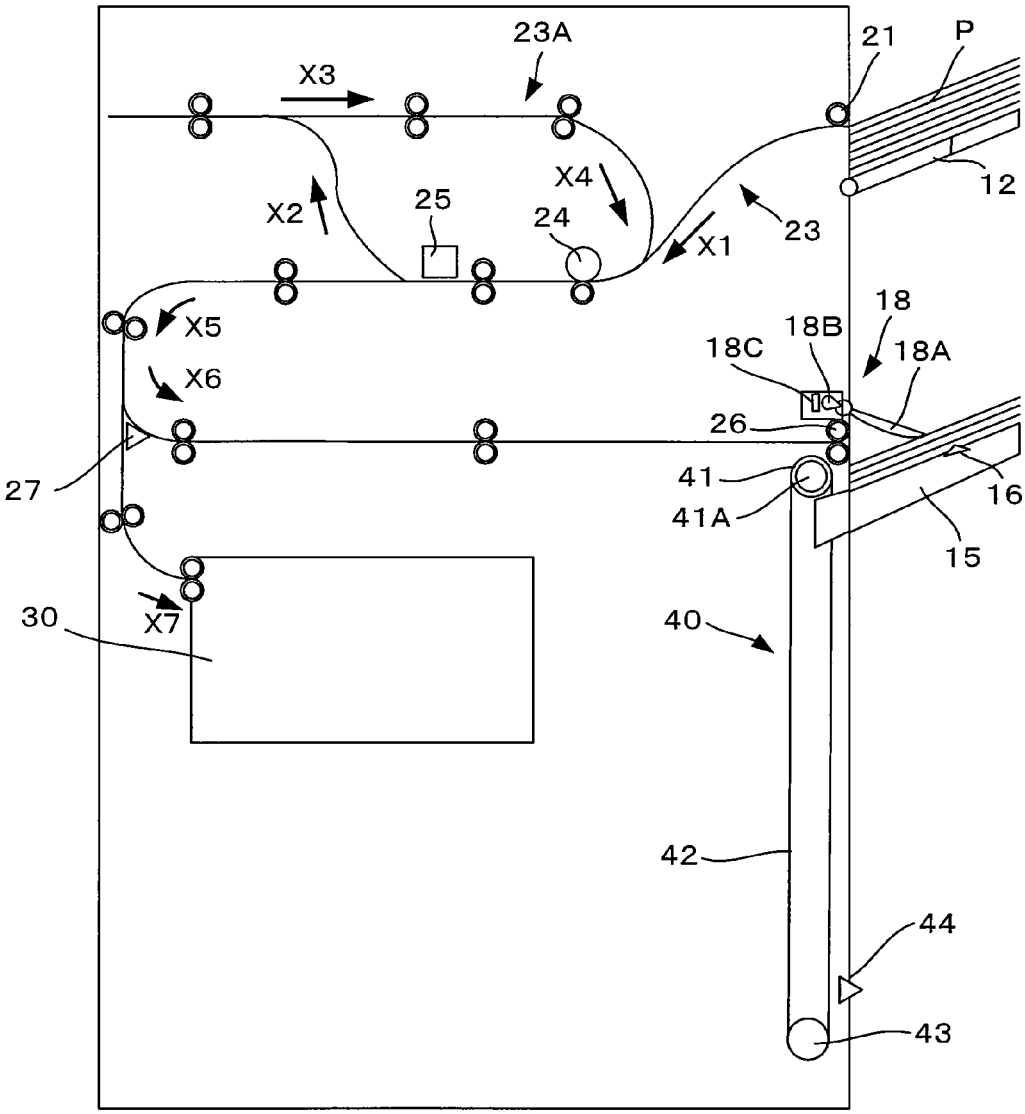
FIG. 2 is a side view illustrating a configuration of the image erasing apparatus.

FIG. 2 is a side view illustrating the configuration of the image erasing apparatus 1. As shown in FIG. 2, the image erasing apparatus 1 includes an entrance roller 21 picking up the recording mediums from the stack tray 12 sheet by sheet and a recording medium carrying mechanism 23 carrying the picked-up recording medium.

In the middle of the recording medium carrying mechanism 23, the image erasing apparatus 1 includes a thermal head 24 as a heater heating the recording medium to a temperature equal to or higher than an image-erasing temperature at which developer is erased, a scanner 25 as an image reading device disposed downstream in the recording medium carrying direction from the thermal head 24 to sense an image on the recording medium, and a recording medium inverting device 23A inverting the recording medium.

The image erasing apparatus 1 includes a recovery box 30 for recovering a recording medium from which an image is not erased. The image erasing apparatus 1 includes a switching device 27 switching a recording medium carrying path between a recording medium carrying mechanism 23 directed to the discharge port 14 and the recording medium carrying mechanism 23 directed to the recovery box 30.

The recording medium height sensor 18 includes an actuator 18A coming in contact with the top surface of the recording medium stacked on the discharge tray 15, a permanent magnet 18B rotating by interlocking with the actuator 18A, and a magnetic sensor 180 detecting the magnetism of the permanent magnet 18B, and outputs a variation in magnetism as an electrical signal.

The recording medium height sensor 18 is disposed so that the rotation center of the actuator 18A is located at the discharge port 14 and the actuator 18A comes in contact with the discharge tray 15 from the rotation center of the actuator 18A.

The discharge tray lifting and lowering mechanism includes a driving roller 41, an encoder 41A interlocking with the driving roller, a belt 42 locking the discharge tray 15, a driven roller 43 rotating the belt 42 along with the driving roller, and a lower limit sensor 44 sensing the lower limit of the discharge tray 15.

The image erasing apparatus 1 includes a shifting mechanism 26 which shifts the discharge position of a recording medium to the discharge port 14.

A recording medium P picked up from the stack tray 12 is carried in the direction X1 of the recording medium carrying mechanism 23. The image erasing apparatus 1 heats the recording medium by the use of the thermal head 24 to erase an image on the top surface.

The image erasing apparatus 1 scans the image of the recording medium by the use of the scanner 25 to determine whether the image is successfully erased. When the image is not successfully erased, the image erasing apparatus 1 controls the switching device 27 to form a recording medium carrying path directed to the recovery box 30, carries the recording medium in the direction of arrow X5 and the direction of arrow X7, and recovers the recording medium into the recovery box 30.

When the image is successfully erased, the image erasing apparatus 1 inverts the recording medium by the use of the recording medium inverting device 23A. That is, the image erasing apparatus 1 carries the recording medium in the directions of arrow X2, arrow X3, and arrow X4 and erases the image on the bottom surface.

The image erasing apparatus 1 scans the image of the recording medium by the use of the scanner 25 to determine whether the image is successfully erased. When the image is not successfully erased, the image erasing apparatus 1 controls the switching device 27 to form a recording medium carrying path directed to the recovery box 30, carries the recording medium in the direction of arrow X5 and the direction of arrow X7, and recovers the recording medium into the recovery box 30.

When the image is successfully erased, the image erasing apparatus 1 discharges the recording medium from the discharge port 14.

Figure 3:
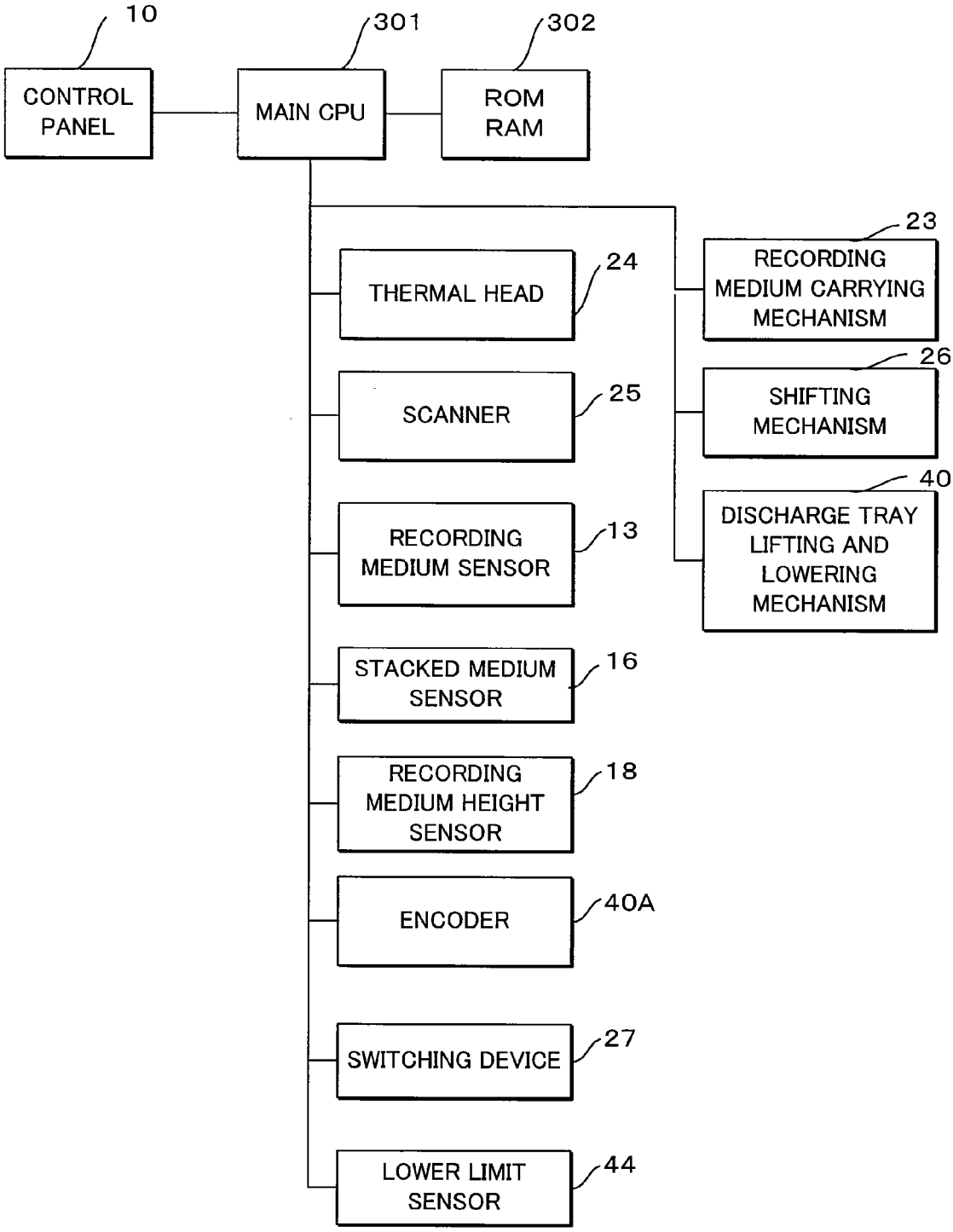
FIG. 3 is a block diagram illustrating a configuration of the image erasing apparatus.

FIG. 3 is a block diagram illustrating the configuration of the image erasing apparatus 1. As shown in FIG. 3, the image erasing apparatus 1 includes a main CPU 301 as a controller, a control panel 10 as an input and output device, and a ROM and RAM 302 as a memory device. The memory device includes a nonvolatile memory.

The main CPU 301 is connected to the thermal head 24, the scanner 25, the recording medium sensor 13, the stacked medium sensor 16, the recording medium height sensor 18, the lower limit sensor 44, and the encoder 40.

The main CPU 301 controls the recording medium carrying mechanism 23, the shifting mechanism 26, the discharge tray lifting and lowering mechanism, and the switching device 27.

Figure 4:
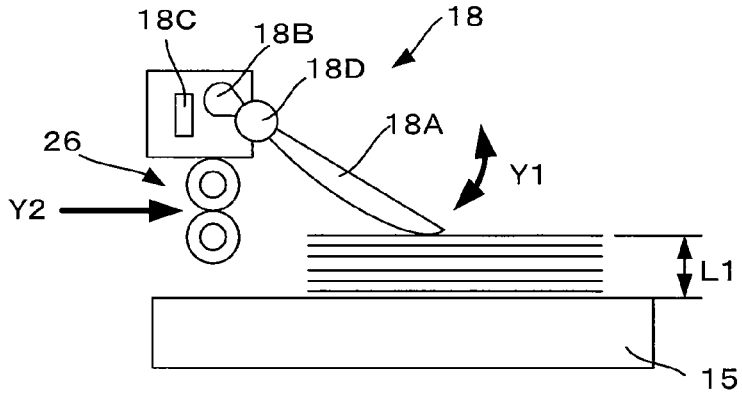
FIG. 4 is a diagram illustrating an operation of carrying a recording medium in the image erasing apparatus.

FIG. 4 is a diagram illustrating a recording medium carrying operation in the image erasing apparatus 1. As shown in FIG. 4, the recording medium is carried in the direction of arrow Y2 and is stacked on the discharge tray 15. As the number of stacked sheets increases, the actuator 18A rotates in the upward direction of arrow Y1.

When the actuator 18A rotates about the rotation center 18D, the permanent magnet 18B rotates. When the permanent magnet 18B rotates, the magnetic field line sensed by the magnetic sensor 18C varies. Accordingly, the image erasing apparatus 1 can sense the height of the stacked recording mediums.

The image erasing apparatus 1 stops the discharging of the recording mediums regardless of the number of stacked recording mediums, when a height-priority mode is specified and the height of recording mediums stacked on the discharge tray 15 reaches a predetermined height L1.

When a number-of-sheets-priority mode is specified and the number of recording mediums stacked on the discharge tray 15 reaches a predetermined number, the image erasing apparatus 1 stops the discharging of the recording mediums regardless of the height of the stacked recording mediums. The number of recording mediums to be discharged is counted by the main CPU 301.

Figure 5:
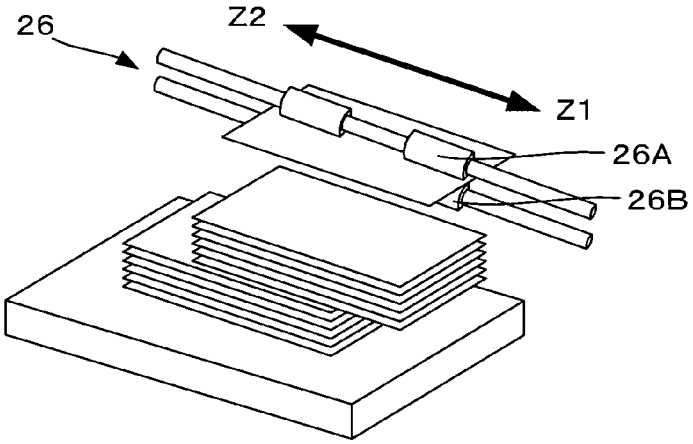
FIG. 5 is a diagram illustrating an operation of a feeding unit.

FIG. 5 is a diagram illustrating the operation of the shifting mechanism 26. As shown in FIG. 5, the shifting mechanism 26 includes a feed driving roller 26A which is driven by a motor and a feed driven roller 26B rotating by interlocking with the feed driving roller 26A and nipping the recording medium. The shifting mechanism 26 is shifted in the direction of arrow Z1 or arrow Z2 by a driving device with the trailing end of the discharged recording medium nipped, and discharges the nipped recording medium after the shift.

The image erasing apparatus 1 operates as follows when a sorting mode is selected. In the height-priority mode, the image erasing apparatus 1 shifts the shifting mechanism in the direction of arrow Z1 to repeatedly discharge the recording mediums up to the predetermined height L1. When the height of the recording mediums stacked on the discharge tray 15 is L1, the image erasing apparatus 1 stops the discharging of the recording mediums and controls the discharge tray lifting and lowering mechanism 40 to lift down the discharge tray 15 until the actuator 18A of the recording medium height sensor 18 is located at the home position.

The image erasing apparatus 1 shifts the shifting mechanism in the direction of arrow Z2 to repeatedly discharge the recording mediums up to a predetermined height L1.

The image erasing apparatus 1 repeatedly performs the operation of feeding the recording mediums and lifting down the discharge tray 15 until no recording medium remains or the lower limit sensor 44 senses that the discharge tray 15 reaches the lower limit.

In the number-of-sheets-priority mode, the image erasing apparatus 1 shifts the shifting mechanism in the direction of arrow Z1 to repeatedly discharge the recording mediums up to a predetermined number of sheets. When the number of recording mediums stacked on the discharge tray 15 is equal to a set number, the image erasing apparatus 1 stops the discharging of the recording mediums and controls the discharge tray lifting and lowering mechanism 40 to lift down the discharge tray 15 until the actuator 18A of the recording medium height sensor 18 is located at the home position.

The image erasing apparatus 1 shifts the shifting mechanism in the direction of arrow Z2 to repeatedly discharge the recording mediums up to a predetermined number of sheets.

The image erasing apparatus 1 repeatedly performs the operation of feeding the recording mediums and lifting down the discharge tray 15 until no recording medium remains or the lower limit sensor 44 senses that the discharge tray 15 reaches the lower limit.

When the height and the number of sheets are both set, the image erasing apparatus 1 shifts the shifting mechanism in the direction of arrow Z1 to repeatedly discharge the recording mediums up to a predetermined height L1 or a predetermined number of sheets. When the height of recording mediums stacked on the discharge tray 15 is equal to the height L1 or the number of recording mediums is equal to the predetermined number of sheets, the image erasing apparatus 1 stops the discharging of the recording mediums and controls the discharge tray lifting and lowering mechanism 40 to lift down the discharge tray 15 until the actuator 18A of the recording medium height sensor 18 is located at the home position.

The image erasing apparatus 1 shifts the shifting mechanism in the direction of arrow Z2 and repeatedly discharges the recording mediums up the predetermined height L1 or the predetermined number of sheets.

The image erasing apparatus 1 repeatedly performs the operation of feeding the recording mediums and lifting down the discharge tray 15 until no recording medium remains or the lower limit sensor 44 senses that the discharge tray 15 reaches the lower limit.

Figure 6:
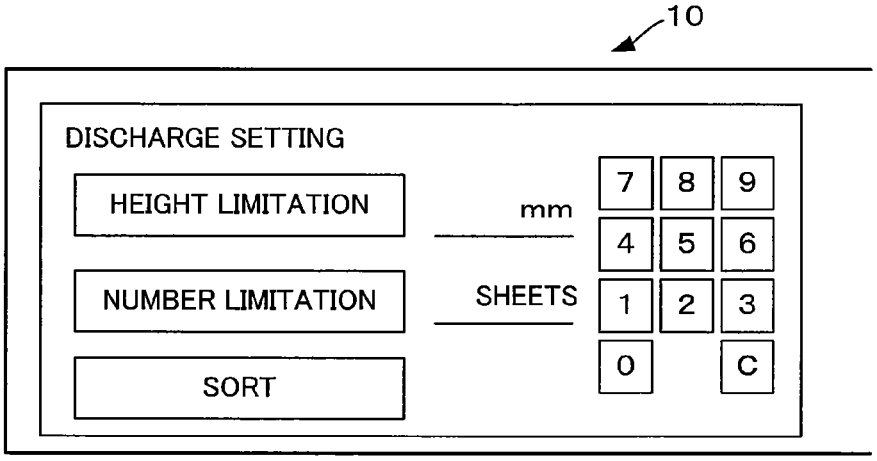
FIG. 6 is a diagram illustrating an example of a discharge setting picture displayed on a control panel of the image erasing apparatus.

FIG. 6 is a diagram illustrating an example of a discharge setting picture displayed on the control panel 10 of the image erasing apparatus 1. As shown in FIG. 6, the image erasing apparatus 1 receives the setting of the height or the number of recording mediums to be stacked or sorted on the discharge tray 15 from the discharge setting picture.

For example, the image erasing apparatus 1 can be set to the height-priority mode when a height limitation is input, and can be set to the number-of-sheets-priority mode when a number limitation is input.

The discharge setting picture can include a button for specifying a sorting mode in addition to the height limitation and the number limitation.

The set values are stored in the nonvolatile memory. Accordingly, it is possible to reduce the labor for re-inputting the set values when the image erasing apparatus 1 is restarted.

Figure 7:
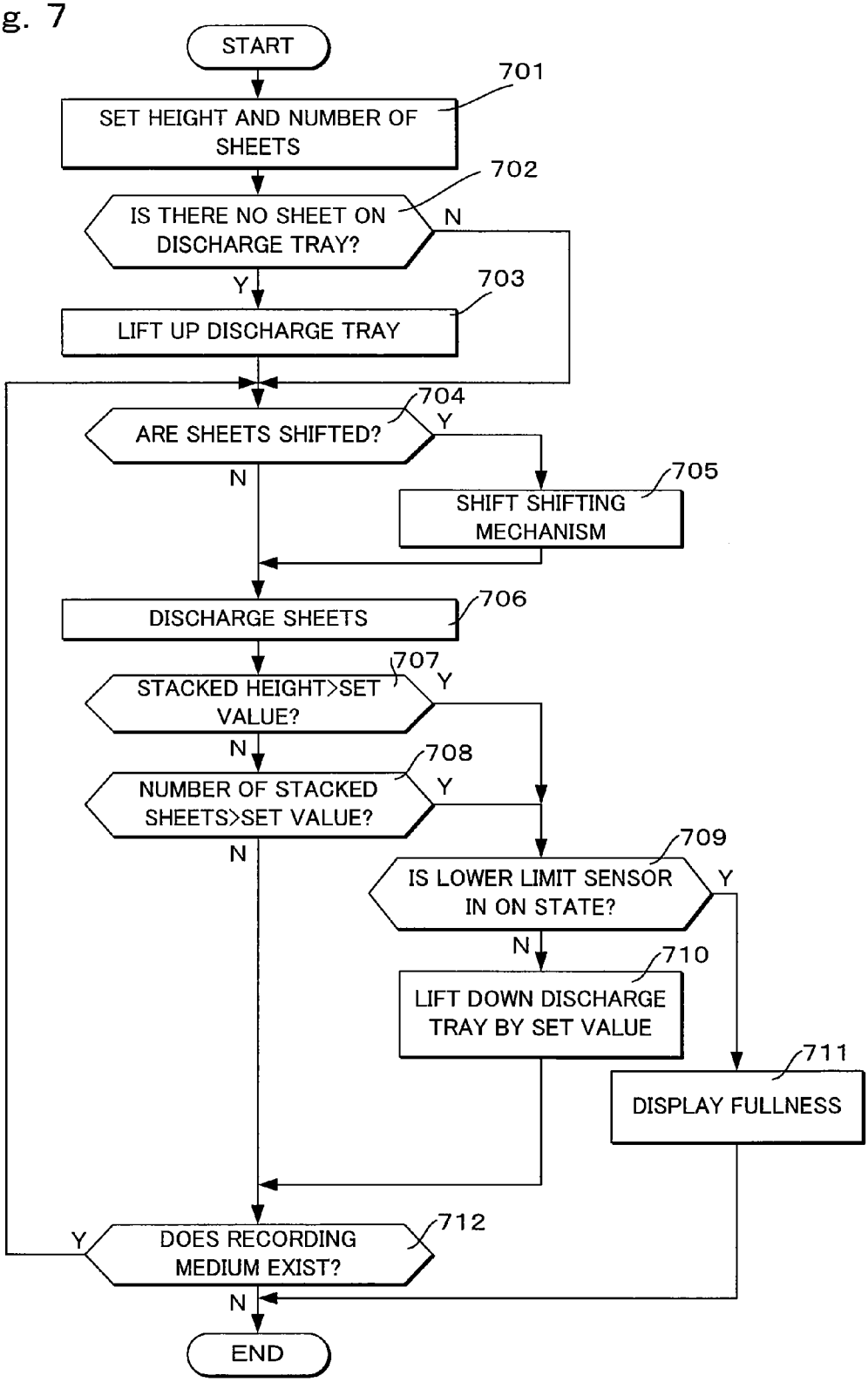
FIG. 7 is a flowchart illustrating an operation of the image erasing apparatus.

FIG. 7 is a flowchart illustrating the operation of the image erasing apparatus 1. As shown in FIG. 7, when the height-priority mode and the sorting mode are specified, the image erasing apparatus 1 receives the setting of the height limitation and the number limitation from the control panel 10 in Act 701.

In Act 702, the image erasing apparatus 1 determines whether a recording medium exists on the discharge tray 15 on the basis of the output of the stacked medium sensor 16. When a recording medium exists, the image erasing apparatus 1 performs the process of Act 704 and performs the process of Act 703 when no recording medium exists.

In Act 703, the image erasing apparatus 1 controls the discharge tray lifting and lowering mechanism 40 to lift up the discharge tray 15 until the actuator 18A of the recording medium height sensor 18 is located at the home position.

In Act 704, the image erasing apparatus 1 determines whether the recording mediums are shifted and discharged. The image erasing apparatus 1 performs the process of Act 705 when the recording mediums are shifted and discharged, and performs the process of Act 706 when the recording mediums are not shifted but discharged.

In Act 705, the image erasing apparatus 1 feeds the recording mediums to the shifting mechanism 26 and the shifting mechanism 26 is shifted in any direction with the recording mediums nipped.

In Act 706, the image erasing apparatus 1 discharges the recording mediums via the shifting mechanism 26.

In Act 707, the image erasing apparatus 1 determines whether the height of recording mediums stacked on the discharge tray 15 is greater than a predetermined value on the basis of the output of the recording medium height sensor 18. The image erasing apparatus 1 performs the process of Act 709 when the height of recording mediums stacked on the discharge tray 15 is greater than the predetermined value, and performs the process of Act 708 when the height is not greater than the predetermined value.

In Act 708, the image erasing apparatus 1 determines whether the number of recording mediums stacked on the discharge tray 15 is greater than a predetermined value. The image erasing apparatus 1 performs the process of Act 709 when the number of recording mediums stacked on the discharge tray 15 is greater than the predetermined value, and performs the process of Act 712 when the number of recording mediums is not greater than the predetermined value.

In Act 709, the image erasing apparatus 1 determines whether the lower limit sensor 44 is in the ON state. When the lower limit sensor 44 is in the ON state, the image erasing apparatus 1 performs the process of Act 711, displays the fullness on the control panel 10, and then ends the operation.

When the lower limit sensor 44 is not in the ON state, the image erasing apparatus 1 performs the process of Act 710, lifts down the discharge tray 15 by a predetermined value, and then performs the process of Act 712.

In Act 712, the image erasing apparatus 1 determines whether a recording medium to be discharged remains. The image erasing apparatus 1 performs the process of Act 704 again when a recording medium to be discharged remains, and ends the operation when a recording medium to be discharged does not remain.

As described above, the image erasing apparatus 1 according to this embodiment includes the recording medium height sensor 18 sensing the height of the recording mediums stacked on the discharge tray 15, the discharge tray lifting and lowering mechanism 40 lifting and lowering the discharge tray 15, the shifting mechanism 26 shifting and discharging the recording mediums, and the controller 301 controlling the discharging operation so that the height of the recording mediums on the discharge tray 15 is equal to a desired height on the basis of the output of the recording medium height sensor 18.

Therefore, even when the numbers of sheets are equal to each other but the heights are different from each other due to curling or folding of the image-formed recording mediums, the image erasing apparatus 1 can form a bundle of recording mediums with a desired height.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image erasing apparatus erasing an image on a sheet, comprising:

an input device configured to accept as input a first value;

a feeder configured to feed a sheet;

a sheet carrying portion configured to carry the sheet fed from the feeder;

an eraser configured to erase an image on the sheet;

a loader configured to load the sheet;

a discharger configured to discharge the sheet to the loader; and a controller configured to receive a second value representative of a height of sheets stacked on the loader, and configured to control the discharger to stop sheet discharge to the loader if the second value is equal to or exceeds the first value.

2. The apparatus according to claim 1, wherein the the input device is configured to accept the first value as input only if the first value is less than a maximum loading value of the loader.

3. The apparatus according to claim 2, wherein further comprising:

a first sensor disposed on the loader configured to sense the height of the sheets loaded on the loader; and a second sensor configured to detect whether the loader is at a height corresponding to the maximum loading value.

4. The apparatus according to claim 3, wherein the loader is configured to move up and down, and the first sensor is configured to sense a height of the sheets loaded on the loader and output the sensed height as the second value.

5. The apparatus according to claim 3, further comprising a switching device configured to switch a sheet discharge position from a first discharge position to a second discharge position, the controller configured to control the discharger to discharge the sheet from the first discharge position to the second discharge position if the second value is equal to or exceeds the first value.

6. The apparatus according to claim 1, wherein the first value is one of a maximum height of the sheets loaded on the loader and a maximum number of the sheets loaded on the loader, and the second value is one of a current height of the sheets loaded on the loader and a current number of sheets loaded on the loader.

7. The apparatus according to claim 1, further comprising a switching device configured to switch a sheet discharge position from a first discharge position to a second discharge position, wherein the first value is one of a maximum height of the sheets loaded on the loader and a maximum number of the sheets loaded on the loader, the second value is one of a current height of the sheets loaded on the loader and a current number of sheets loaded on the loader, and the controller controls the switching device to switch the sheet discharge position from the first discharge position to the second discharge position, if the current number of the sheets loaded on the loader is equal to or exceeds the first value or if the current height of the sheets loaded on the loader is equal to or exceeds the first value.

8. The apparatus according to claim 1, further comprising a switching device configured to switch a sheet discharge position from a first discharge position to a second discharge position, wherein the first value is one of a maximum height of the sheets loaded on the loader and a maximum number of the sheets loaded on the loader, the second value is one of a current height of the sheets loaded on the loader and a current number of sheets loaded on the loader, and the controller determines, based on an input value accepted in the input device, whether to control the discharger to stop discharging or whether to control the switching device to switch the sheet discharge position from the first discharge position to the second discharge position, if the second value is equal to or exceeds the first value.

9. A method of carrying a sheet in an image erasing apparatus erasing an image on the sheet, comprising:

receiving a first value from an input device;

feeding a sheet by a feeder;

carrying the sheet fed from the feeder;

erasing an image on the sheet;

loading a sheet;

discharging the sheet to a loader;

generating a second value representative of a height of sheets stacked on the loader; and stopping discharging of the sheet to the loader if the second value is equal to or exceeds the first value.

10. The method according to claim 9, wherein the first value is accepted as input only if the first value is less than a maximum loading value of the loader.

11. The method according to claim 10, further comprising:

generating the second value with a first sensor disposed on the loader; and detecting whether the loader is at a height corresponding to the maximum loading value.

12. The method according to claim 11, wherein the loader moves up and down, the method further comprising:

sensing, with the first sensor, a height of the sheets loaded on the loader, and outputting the sensed height as the second value.

13. The method according to claim 11, further comprising switching a sheet discharge position from a first switching position to a second switching position if the second value is equal to or exceeds the first value.

14. The method according to claim 9, wherein the first value is one of a maximum height of the sheets loaded on the loader and a maximum number of the sheets loaded on the loader, and the second value is one of a current height of the sheets loaded on the loader and a current number of sheets loaded on the loader.

15. The method according to claim 9, wherein the first value is one of a maximum height of the sheets loaded on the loader and a maximum number of the sheets loaded on the loader, and the second value is one of a current height of the sheets loaded on the loader and a current number of sheets loaded on the loader, the method further comprising:

switching a sheet discharge position from a first switching position to a second switching position if the second value is equal to or exceeds the first value.

16. The method according to claim 9, wherein the first value is one of a maximum height of the sheets loaded on the loader and a maximum number of the sheets loaded on the loader, and the second value is one of a current height of the sheets loaded on the loader and a current number of sheets loaded on the loader, the method further comprising:

determining, based on a received input value, whether to stop discharging or whether to switch a sheet discharge position from a first switching position to a second switching position, if the second value is equal to or exceeds the first value.

17. The method according to claim 11, further comprising:

lowering the discharge tray, and stopping sheet discharge, if the current height of the sheets loaded on the discharge tray reaches a predetermined height before the current number of sheets loaded on the discharge tray reaches a predetermined number.

18. The method according to claim 11, further comprising storing the input first value in a nonvolatile memory.

19. The method according to claim 11, further comprising determining, based on a received input value, whether to stop sheet discharge, if the current height of the sheets loaded on the discharge tray reaches a predetermined height before the current number of sheets loaded on the discharge tray reaches a predetermined number of.

20. The method according to claim 14, further comprising: lowering the discharge tray, and determining, based on a received input value, whether to switch a sheet discharge position from the first switching position to the second switching position, if the current height of the sheets loaded on the loader is greater than a predetermined height.

* * * * *